US006408936B2

(12) United States Patent
Duran

(10) Patent No.: US 6,408,936 B2
(45) Date of Patent: Jun. 25, 2002

(54) TO HEAT EXCHANGERS

(75) Inventor: Jesus Pagan Duran, Murcia (ES)

(73) Assignee: HRS Spiratube S.L., Murcia (ES)

( * ) Notice: Subject to any disclaimer, the term of this patent is extended or adjusted under 35 U.S.C. 154(b) by 0 days.

(21) Appl. No.: 09/761,449

(22) Filed: Jan. 16, 2001

Related U.S. Application Data

(63) Continuation of application No. PCT/EP99/05077, filed on Jul. 16, 1999.

(30) Foreign Application Priority Data

Jul. 16, 1998 (ES) ..... 9801521

(51) Int. Cl.[7] ..... F28F 17/00

(52) U.S. Cl. ..... 165/94; 165/95; 15/104.05; 15/104.16

(58) Field of Search ..... 165/94, 95, 109.1, 165/5, 303; 15/104.16, 104.05; 138/38

(56) References Cited

U.S. PATENT DOCUMENTS

| | | | |
|---|---|---|---|
| 3,259,179 | A | 7/1966 | Leach |
| 3,384,161 | A | 5/1968 | Malmstrom et al. |
| 3,973,623 | A | 8/1976 | Sarll |
| 4,330,032 | A | 5/1982 | Koppelman et al. |
| 4,718,480 | A | 1/1988 | Kito et al. |
| 5,311,929 | A | 5/1994 | Verret |

FOREIGN PATENT DOCUMENTS

| | | | |
|---|---|---|---|
| DE | 296188 | | 1/1917 |
| DE | 296 10 899 | U1 | 12/1997 |
| EP | 0 453 043 | A1 | 10/1991 |
| EP | 0 730 893 | A1 | 9/1996 |
| EP | 0 730 893 | B1 | 12/1999 |
| FR | 2 224 728 | | 10/1974 |
| GB | 1 371 998 | | 10/1974 |
| JP | 62-57602 | | 3/1987 |
| WO | WO 81/00905 | | 4/1981 |
| WO | WO 83/03892 | | 11/1983 |

*Primary Examiner*—Henry Bennett
*Assistant Examiner*—Terrell McKinnon
(74) *Attorney, Agent, or Firm*—Dicke, Billig & Czaja, P.A.

(57) ABSTRACT

A heat exchanger assembly comprises a tubular casing (1) housing product conduit pipe (8) and a rod (14) extending through each pipe (8). The rod (14) being reciprocatingly moveable along the pipe (8) and having a scraping means (15) projecting from it such that upon reciprocation of the rod (14) within the pipe (8) the scraping means (15) will scrape product residues from the inner walls of the product conduit (8), allowing improved heat transfer to be achieved whilst the assembly continues to operate.

23 Claims, 9 Drawing Sheets

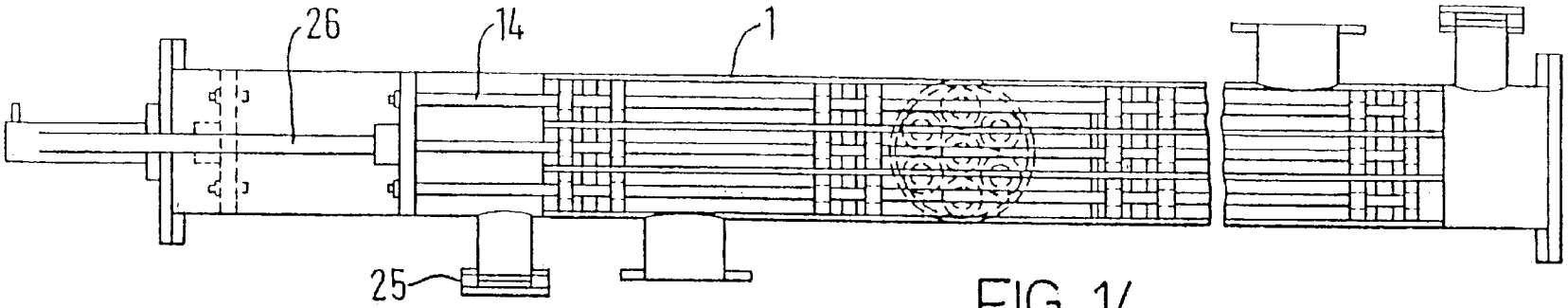
FIG. 14
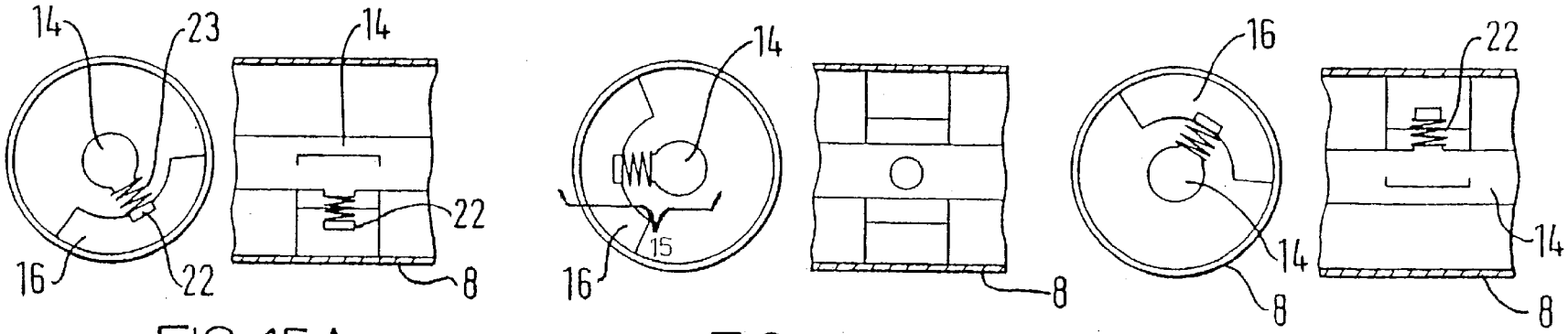
FIG. 15C
FIG. 15B
FIG. 15A
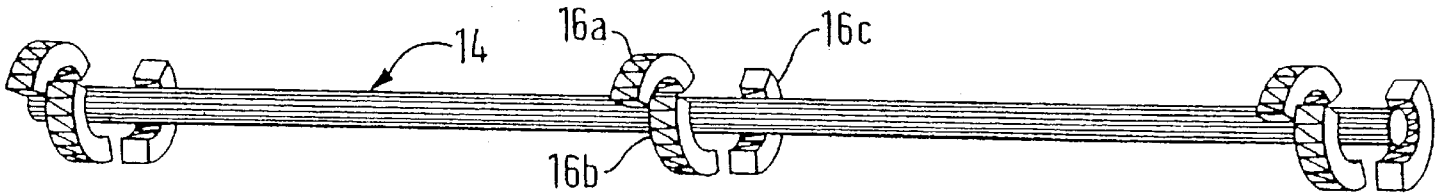
FIG. 16

TO HEAT EXCHANGERS

This is a continuation of International Application No. PCT/EP99/05077 filed Jul. 16, 1999, which was published under PCT Article 21(2) in English; this application also claims priority under 35 U.S.C. § 119 to Spanish Patent Application No. P 9801521, filed Jul. 16, 1998.

The present invention relates to a heat exchanger assembly for heat exchange treatment of substances or mixtures of substances, for example in which the application of a heat differential produces a change in temperature of a substance or a partial or complete change of state of a substance. The invention is particularly suitable for use in heat exchangers, evaporators and freeze crystallisation systems, particularly, but not exclusively, in the food, pharmaceutical and chemical industries. In particular, the invention is suitable for use in heat exchanger systems for treatment of fluid foods such as, for example, in pasteurisation of fruit juices or dairy products such as milk or yoghurt.

Tubular heat exchangers are commonly used in the food industry for heating or cooling of fluid food products. By the very nature of the products that they carry, the heat exchangers need to be inspected and vigorously cleaned on a regular basis to prevent build-up of solid organic or inorganic matter. Fatty or proteinaceous deposits will accumulate where conditions allow fouling to occur or, depending upon the role of the heat exchanger, through searing or freezing to the inner walls or the tubes of the heat exchanger. Inevitably, therefore, a substantial amount of production time and hence production efficiency is lost through these routine maintenance measures.

In some installations, the problem of residue accumulation around the inner walls of the heat exchanger product-carrying tubing is exacerbated by measures taken to enhance turbulence within the heat exchanger tubes. These commonly involve provision of turbulence-inducing projections or fins on an inner surface of the product tubing and along its length. Such turbulence-inducing fins or other projections are desirable to enhance the effectiveness of heat exchange but their side effect in increasing the surfaces on which residues may accumulate is decidedly undesirable.

Various arrangements specifically for cleaning heat exchangers are known, which arrangements typically comprise a scraper of some form passing along the heat exchange tube. A number of problems arise with such arrangements for example, the scraping of the product tubes causes the scraper to be worn away, thereby losing contact with the inner walls of the product tubes and allowing deposition of solid matter on to the walls of the product tubes. As a result of this, such systems require frequent maintenance, resulting in the loss of a substantial amount of production time and hence production efficiency. In addition, it is often necessary to replace the entire scraper each time.

EP0453043A describes a heat exchanger system in which solid particles are introduced into the product tube to clean its walls. These solid particles enter one end of the product tube and traverse its length until they are discharged from its other end. The solid particles are then directed to a collector where they are cleaned and fed back into the heat exchanger. A disadvantage of this system is that it requires the isolation, cleaning and reintroduction of the solid particles after each pass through the product tube, which is time consuming and cumbersome.

FR2224728 discloses the use of a scraping device within a heat exchanger product tube. A central rod is spirally wound with the scraping means, which contacts the inside of the product tube. However this arrangement suffers from a number of the problems identified above.

It is a general objective of the present invention to provide an improved heat exchanger assembly which is adapted to mitigate or overcome these and other problems of the prior art.

According to one aspect of the present invention, there is provided a heat exchanger assembly which comprises an elongate casing housing at least one product conduit extending substantially longitudinally therethrough and with a void surrounding the product conduit receiving, in use, heat exchange service fluid flowing therethrough, characterised in that the assembly further comprises a rod extending through the product conduit, said rod being moveable in a reciprocating manner along the conduit and having a scraping means radially projecting therefrom such that upon reciprocation of the rod within the product conduit, the scraping means scrape product residues from the inner walls of the product conduit.

Preferably, the assembly has a plurality of conduit tubes extending substantially longitudinally through the casing and a plurality of rods, each rod extending through a conduit tube, the rods being moveable in a reciprocating manner together by a common reciprocating drive means.

The plurality of rods may be mounted in a base plate that is housed within the casing or an extension of the casing to move with the base plate, the base plate being moved in a reciprocating manner by the reciprocating drive means.

The scraping means suitably comprises a scraping head mounted upon an arm projecting radially from the rod, and the scraping head may be moveable along the arm and biased by resilient biasing means.

The scraping means may have an arcuate radial outer surface. The scrapers are preferably arranged at different radial orientations along the length of the rod, and may be arranged in groups of two or three scrapers at intervals along the length of the rod with each member of the group at a different respective radial orientation.

The assembly may be adapted to function as a pump through use of a valve in the product fluid inlet.

Preferably, the assembly further comprises a controller to control the reciprocation of the rod(s) at predetermined intervals or in response to sensed temperature of the product or service fluid.

Preferably, the product conduit is a tube, which may have a circular cross section.

According to another aspect of the present invention there is provided a heat exchanger assembly which comprises a casing housing at least one product conduit extending substantially therethrough and with a void surrounding the product conduit receiving, in use, heat exchange service fluid, characterised in that the assembly further comprises a mount extending through the product conduit, said mount being moveable in a reciprocating manner along the product conduit and having a turbulence generating member projecting therefrom, such that upon reciprocation of the mount within the product conduit in use, the member causes turbulence within the product conduit.

A plurality of turbulence generating members may be provided, preferably with each member positioned at a different orientation around the axis of the mount.

Preferably the turbulence-generating member has a triangular cross section, wherein each corner of the triangle substantially contacts an inner surface of the product conduit. The corners of the triangular member may be curved or rounded off slightly.

Preferred embodiments of the present invention will now be more particularly described, by way of example, with reference to the accompanying drawings, wherein:

FIG. 14 is a schematic longitudinal sectional drawing of the assembly;

FIGS. 15A, 15B and 15C illustrate side and end elevation views of the configuration of each one of a group of three grouped scraper elements; and FIG. 16 is a perspective view of the scraper rod and grouped scraper element configuration of the second embodiment.

Figure 1:
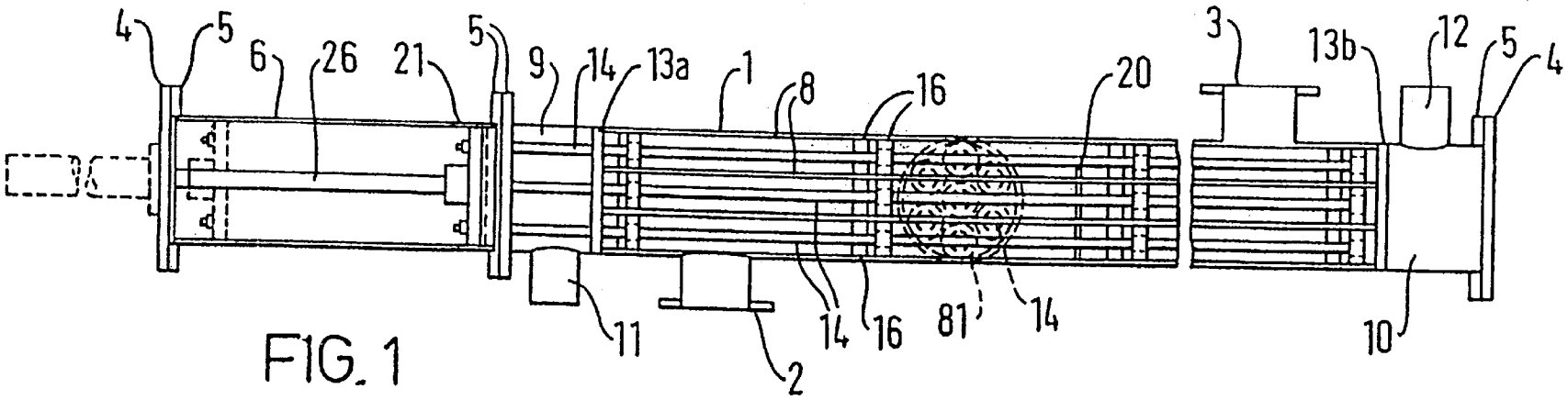
FIG. 1 is a schematic longitudinal sectional drawing of the assembly.
Figure 2:
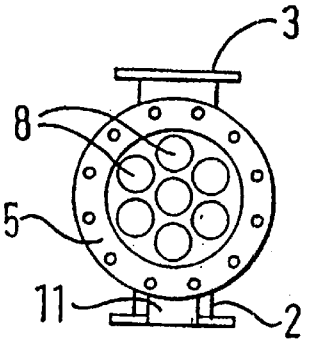
FIG. 2 is an end elevation view of the main heat exchanger casing of the assembly of FIG. 1.

As illustrated in FIGS. 1 and 2, in a preferred embodiment, the main body of the heat exchanger assembly comprises a tubular heat exchanger casing through which heat exchange service fluid—for example, glycol refrigerant for cooling or high temperature water or steam for heating—passes from an inlet port 2 near one end of the casing 1 along the casing 1 and out through an outlet port 3 near the other end of the casing 1.

Figure 3:
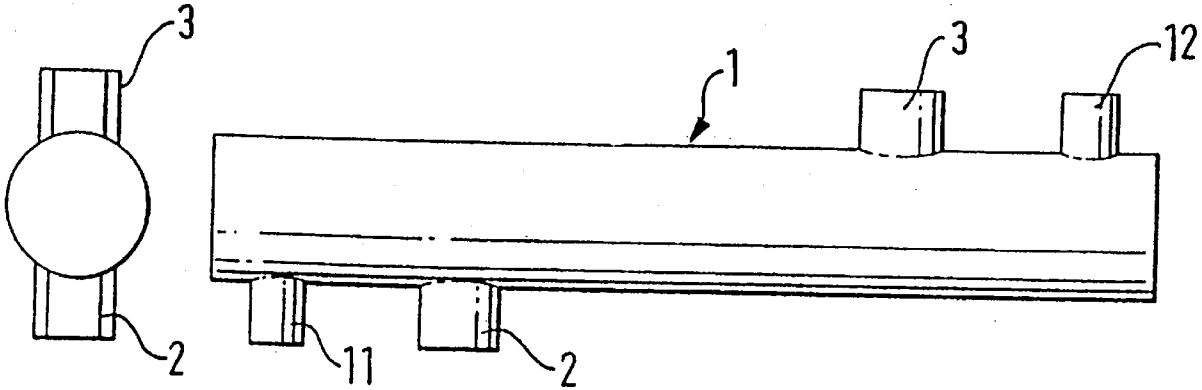
FIG. 3 illustrates side and end elevation views of the heat exchanger casing in the FIG. 1 assembly.
Figure 4:
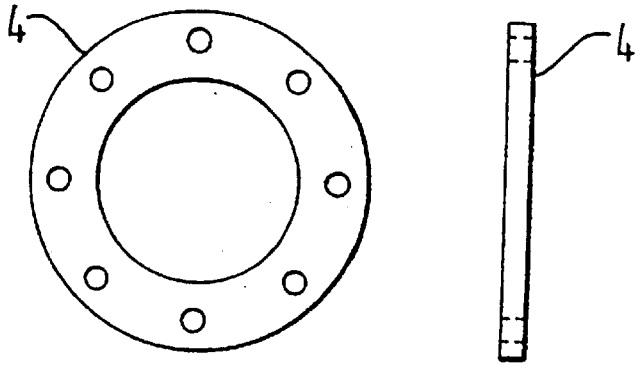
FIG. 4 illustrates side and end elevation views of an annular flange plate.
Figure 5:
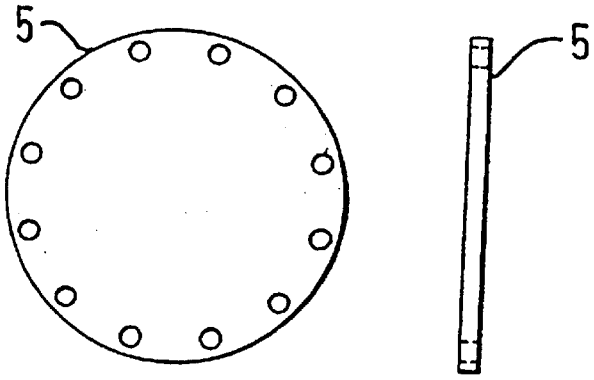
FIG. 5 illustrates side and end elevation views of an end plate.

The casing 1 is suitably formed as a hollow, open-ended tube (see FIG. 3) and is adapted to be interchangeable in the installation into which it is mounted for use. The opposing longitudinal ends of the casing 1 are sealed off in use by end plates 4 (FIG. 4) abutting against annular flange plates 5 (see FIG. 5) and with a gasket or other suitably elastomeric sealing means between the end plate 4 and annular flange plate 5.

Figure 6:
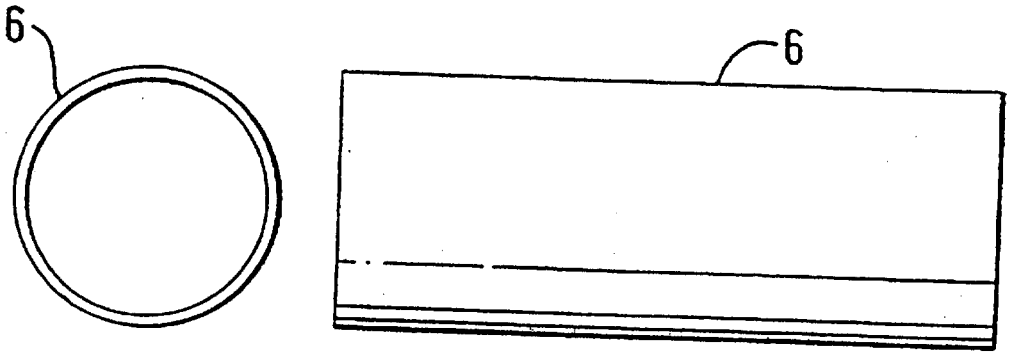
FIG. 6 illustrates side and end elevation views of a piston casing'
Figure 12:
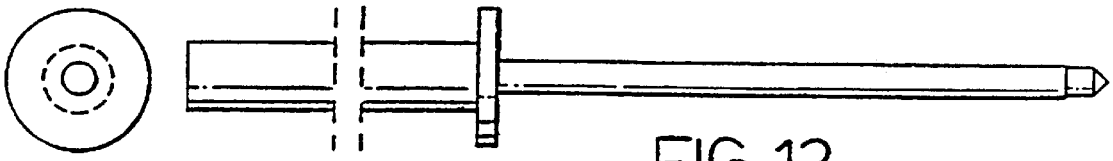
FIG. 12 illustrates side and end elevation views of a piston connecting rod for transmission of reciprocating motion from a piston to the scraper rod base mounting plate.
Figure 13:
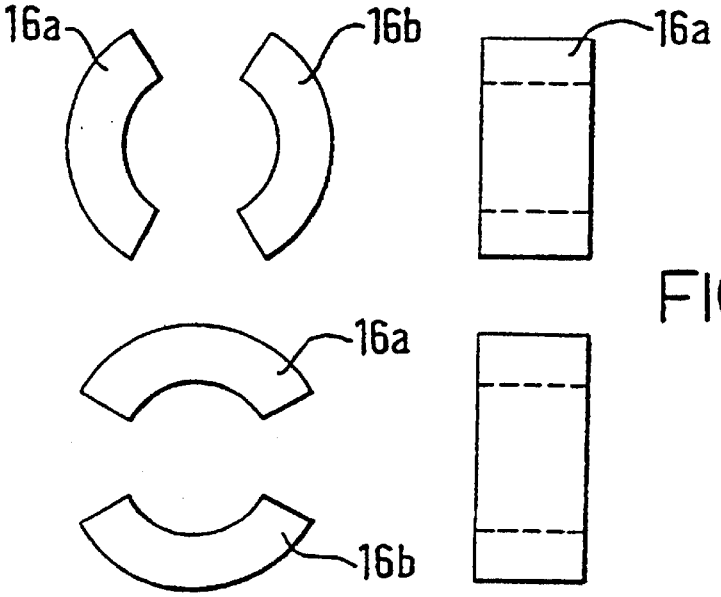
FIG. 13 illustrates side and end elevation views of a pair of scrapers, each comprising a pair of scraper elements.

As illustrated, the heat exchanger casing 1 has at one end an extension comprising a tubular piston casing 6 (see FIG. 6) on a remote end of which is mounted the end plate 4. The piston casing 6 houses a connecting rod 26 (FIG. 12) which transmits the reciprocating motion from a piston 27 (shown in ghost outline on FIG. 1 and in solid outline on FIG. 14). The connecting rod 26 extends through an aperture in the end plate 4 and is surrounded by an annular elastomeric seal.

Figure 7:
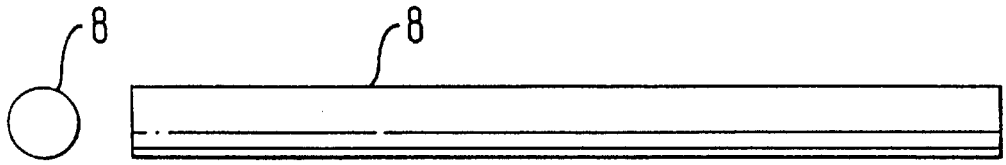
FIG. 7 illustrates side and end elevation view of an inner pipe (or inner product conduit tube)

In common with many conventional designs of heat exchanger, a plurality of inner product conduit tubes or pipes 8 (FIG. 7) are provided extending along the chamber within the heat exchanger casing 1. The illustrated embodiment comprises 7 such inner pipes 8 arranged in a symmetrical configuration and all in open communication with a product inlet chamber 9 at an inlet end of the heat exchanger casing 1 and an outlet chamber 10 at an outlet end of the heat exchanger casing 1.

In operation, the product to be treated by the heat exchanger passes into the inlet chamber 9 through an inlet port 11 and enters each of the inner tubes 8 to pass therealong and out into the outlet chamber 10 and outlet port 12, all the while being physically isolated from the refrigerant or heating service fluid. The service fluid is pumped along the casing 1 surrounding the inner tubes 8 from the service fluid inlet port 2 to the outlet port 3. Heat exchange occurs between the service fluid surrounding the inner pipes 8 and the product passing within those pipes 8.

Figure 8:
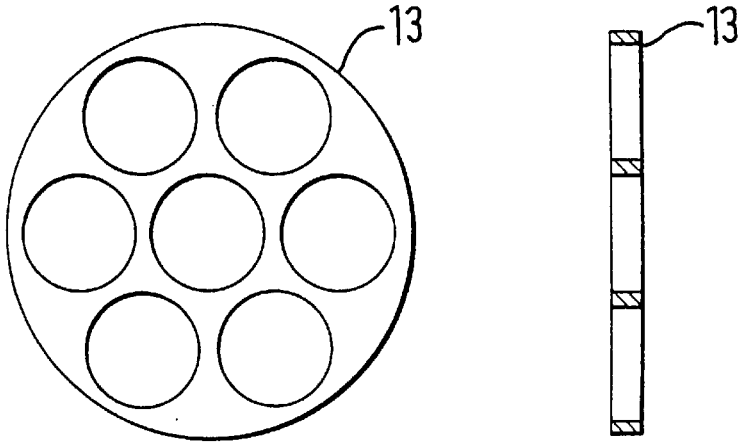
FIG. 8 illustrates side and end elevation views of a mounting plate for the inner pipes.
Figure 9:
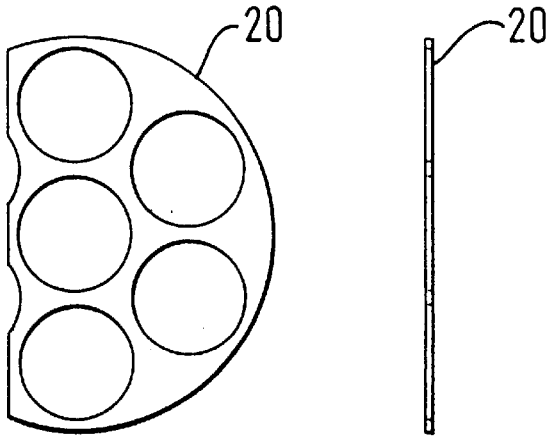
FIG. 9 illustrates side and end elevation views of a baffle plate.
Figure 10:
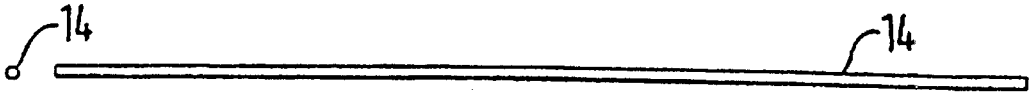
FIG. 10 illustrates side and end elevation views of a scraper rod.

A respective mounting plate 13*a*, 13*b* (see FIG. 8) is provided at each opposing end of the inner pipes 8 and not only holds those pipes 8 in their symmetrical array but also serves as a barrier wall between the product and service fluid. A further part cut-away plate 20 (see FIG. 9) provides additional support to the pipes 9 at an intermediate stage along their length and serves as a baffle plate to induce turbulence of the service fluid.

Figure 11:
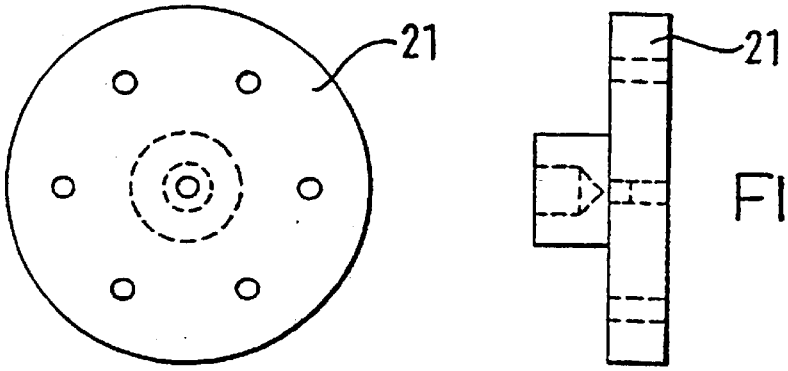
FIG. 11 illustrates side and end elevation views of a base mounting plate for mounting of the scraper rods.

In view of the earlier mentioned problems of the existing prior art systems in maxmising heat exchange through inducing turbulence in the product while attempting to control residue built-up within the inner pipes, the assembly has been adapted to further comprise a set of rods 14, each rod 14 mounted co-axially within a respective inner pipe 8 and adapted to reciprocate along the pipe 8. Each of the rods 14 is mounted at one end in a base plate 21 (see FIG. 11) that is, in turn, slideably mounted within the piston casing 6 and which has a seal around its rim in use preventing escape of the product fluid.

At intervals along their lengths, the rods 14 each carry a pair of scrapers that are fixed to the rod 14 extending radially and spring biased radially outwardly. These serve to scrape the inner wall of the corresponding inner pipe 8 as the rod 14 is moved back and forth within the pipe 8. For the avoidance of doubt, although the rods 14 are illustrated as having a circular section, they may be of any cross sectional shape and the term "radially" encompasses the arrangement where the scrapers project laterally from a rod that is, for example, rectangular in cross section.

Each of the scrapers 15 has a pair of radially opposed arcuate scraper elements 16*a*, 16*b* (see FIG. 12 and FIGS. 14 and 15) having an outer surface shaped to conform to the shape of the wall of the inner pipe 8. They are each mounted on and spaced from the respective reciprocating rod 14 by, an arm 22, which arm 22 extends radially from the rod 14 into a socket in the scraper element 16*a*, 16*b*. Each scraper element 16*a*, 16*b* is held captive on its arm 22 but is displaceable inwardly along the arm and is biased outwardly by a resilient biasing means, which in this case is a compression spring 23 that is coiled around the arm 22 and is threadedly secured in the socket of the scraper element 16*a*, 16*b*.

Figure 17:
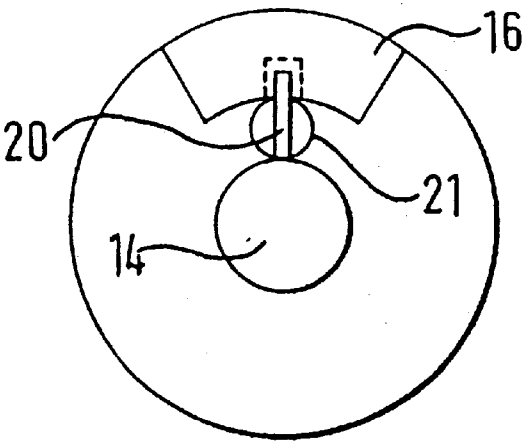
FIG. 17 illustrates an end elevation view of a preferred embodiment of the resilient biasing means with the scraper head mounted on a pin surrounded by a compressed deformable elastomer

Although in FIG. 15 the resilient biasing means is illustrated as a compression spring 23, the resilient biasing means can be any structure which biases the scraper element 16*a*, 16*b* into engagement with the inner wall, for example, a deformable Teflon™ coated arm of resilient plastic material. Alternatively, the scraper means could be attached to the rod 14 by a radially extending pin 20 preferably made of stainless steel which is attached directly to the rod 14 and is received in a socket formed on the inner surface of the scraper element 16*a,b* as shown in FIG. 17. The arrangement of the pin 20 and the scraper element 16*a, b* is such that the element is held captive on the pin 20 but is displaceable along its length. Surrounding coiled pin 20 is a compressed and resiliently deformable elastomer 21 (e.g. compressed silicon rubber) which engages with and outwardly biases the scraper element 16*a,b*. Wearing of the scraper means causes the elastomer 21 to expand, which in turn causes the scraping means 16 to move along the pin 20 and outwards towards the inner wall.

The resilient biasing means provides a mechanism for minimising the risk of the scrapers becoming jammed or scouring the inner walls of the inner pipes 8. The action of the resilient biasing means maintains the contact between the scraping means and the inner walls of the product conduit tubes. If the surface of the scraping means is worn away, the resilient biasing means will compensate for the reduced size of the scraping means and maintain the contact between the scraping means and the inner wall reducing the frequency with which the scraping means require replacement. It will be noted that the provision of discrete scraping means elements allows a single element to be replaced when worn rather than the whole assembly.

The radial spacing between the rod 14 and scraper element 16*a*, 16*b* and the circumferential spacing between the respective opposing scraper elements 16*a*, 16*b* allows the passage of the product along the inner pipe 8 in use.

In the illustrated embodiment not only are the scrapers 15 each composed of a pair of radially opposing scraper elements 16*a*, 16*b* but also each scraper 15 is paired with another scraper 15 spaced slightly further along the rod 14 and angled at a different radial orientation from the rod 14. The scrapers 15 of each pair are suitably angled apart by 90° and separated by a distance of the order of 10 mm. This optimises turbulence while not obstructing the required flow of the product through the pipes 8. As a result of this arrangement, the scraper elements 16*a* and 16*b* provide complete coverage of the heat transfer surface. In addition, this arrangement allows free passage of the substances of mixtures of substances passing through the heat exchanger, allowing cleaning to occur concomitantly with the heat exchange process.

In use, the reciprocating motion of the rods 14 in moving the scrapers 15 back and forth induces the desired turbulence in the product to optimise the efficiency of the heat exchange process. The action of the scraping means moves the boundary layer of the substance deposited on the heat transfer surface away from the surface into the bulk of the substance or mixture of substances. Therefore, this turbulence is attained not only without increasing the risk of residue build-up but by positively reducing it.

In addition to the benefits of scraping and inducing turbulence, the reciprocating rods 14 may also be used to assist in drainage of the product paths of the heat exchanger 1 at the end of a production run.

In a modification of the apparatus illustrated in FIG. 14, a one-way flow valve 25 may be incorporated into the product inlet pipe 11 whereby the reciprocating action of the rod mounting base plate 21 pumps the product through the heat exchanger.

Reciprocation of the rods 14 and associated scrapers 15 can occur continuously or intermittently.

During normal operation of the system for turbulence induction, the reciprocation of the rods 14 and associated scrapers 15 is suitably carried out cyclically and intermittently at, for example, intervals of several minutes and is suitably under the control of a control means comprising a micro controller, micro processor or CPU and operating software. In addition, the speed of reciprocation may be varied.

If desired, the system may be enhanced by provision of temperature sensors to sense the temperature of the product fluid and/or service fluid suitably near, the outlet of the heat exchanger to determine whether the heat exchange process is effective. The sensed temperature may be used as an input to the controller to adjust the rate of reciprocation of the rods.

In the first described and illustrated embodiment, the scrapers 15 comprise pairs of opposing scraper elements 16*a*, 16*b* and are arranged on each rod at intervals in pairs angled 90° apart. In the embodiment of FIGS. 14 to 16, the scrapers 15 are arranged in groups of three single scraper elements slightly spaced along the rod 8 and angled successively at 60° apart. This arrangement of the scraper elements 16*a*, 16*b* and 16*c* provides complete coverage of the heat transfer surface and allows the free passage of the substances or mixtures of substances passing through the heat exchanger.

It will be appreciated that the product conduit tube can be of any desired cross-sectional shape and that the scrapers can be configured accordingly. In addition the heat exchanger assembly can be used for any appropriate product, not only food products.

While the previously described heat exchanger is a single pass exchanger, it will be appreciated that the present invention can equally be applied to multi-pass heat exchangers. Multi-pass heat exchangers typically comprise a plurality of interconnected inner product conduit tubes or pipes 8 that extend within a casing 1 that is closed at either end by header portions 18,19.

FIGS. 20 to 23 show sections through suitable header portions. Each header portion 18,19 has a plurality of specially arranged cavities formed on the side that faces the ends of the pipes 8. In the header 18, for example, a first cavity 30 is arranged so that when mounted on the casing 1, the end of a first one of the pipes 32 opens into it. In communication with this first cavity 30 is a product inlet port (not shown). The other cavities 34, 38 and 42 are arranged so that pipes 31 and 32, 35 and 36 and 43 and 44 respectively open into them. At the opposite end of the casing 1, the cavities of the header portion 19 are arranged so that the other ends of pipes 29 and 31 open into cavity 46, those of pipes 36 and 43 open into cavity 48, those of pipes 32 and 44 open into cavity 50 and that of pipe 35 opens into cavity 52, which is in fluid communication with an outlet port (not shown). In this way, the pipes of the heat exchanger are in fluid communication with each other.

As before, extending through each pipe, and additionally in this case the header portion 18, is a rod 14 that carries scraping means. Any of the various types of scraping means previously described in relation to the single pass heat exchanger can, of course, be used in the multi-pass system. In order to ensure that there is no leakage from the product tubes, lip seals are provided where the rods 14 extend through the header portion 18.

As before, reciprocating motion of the rods 14 moves the scrapers 15 back and forth and induces the desired turbulence in the product to optimise the efficiency of the heat exchange process. The action of the scraping means also moves the boundary layer of the substance deposited on the heat transfer surface away from the surface into the bulk of the substance-or mixture of substances.

In use of this system, the product passes into the heat exchanger through the inlet port that opens into cavity 30 and from there into the tube 29. When the product reaches the end of tube 29 it is redirected by the header portion 19 into tube 31 and travels along in the opposite direction until it reaches the header portion 18, where it is again re-directed, but this time into tube 32. The product passes through each of tubes in turn via the header portions 18 and 19 alternately until it reaches the end of tube 35 whereupon it leaves the heat exchanger via an outlet port.

Figure 18:
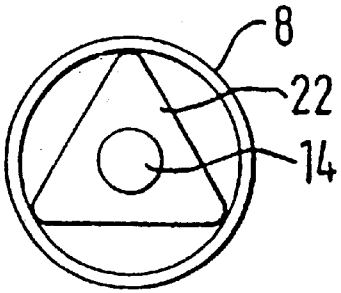
FIG. 18 illustrates an end elevation of a turbulence inducing element.
Figure 19:
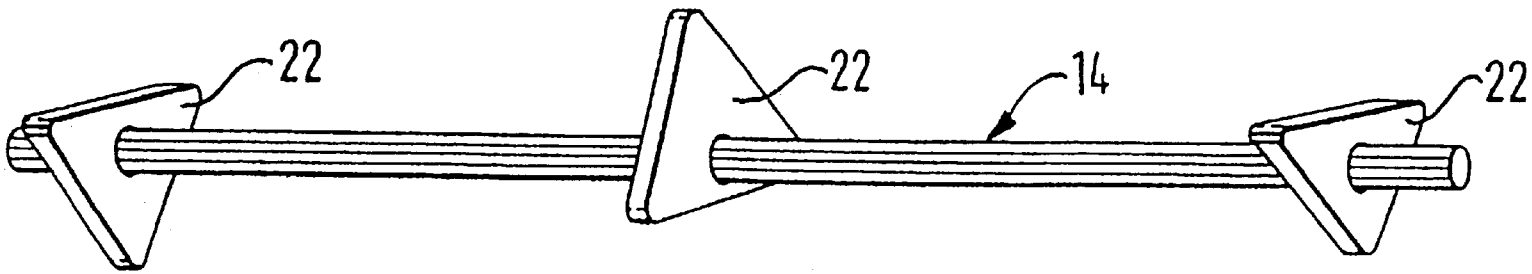
FIG. 19 is a perspective view of the rod and group turbulence inducing elements.
Figure 20:
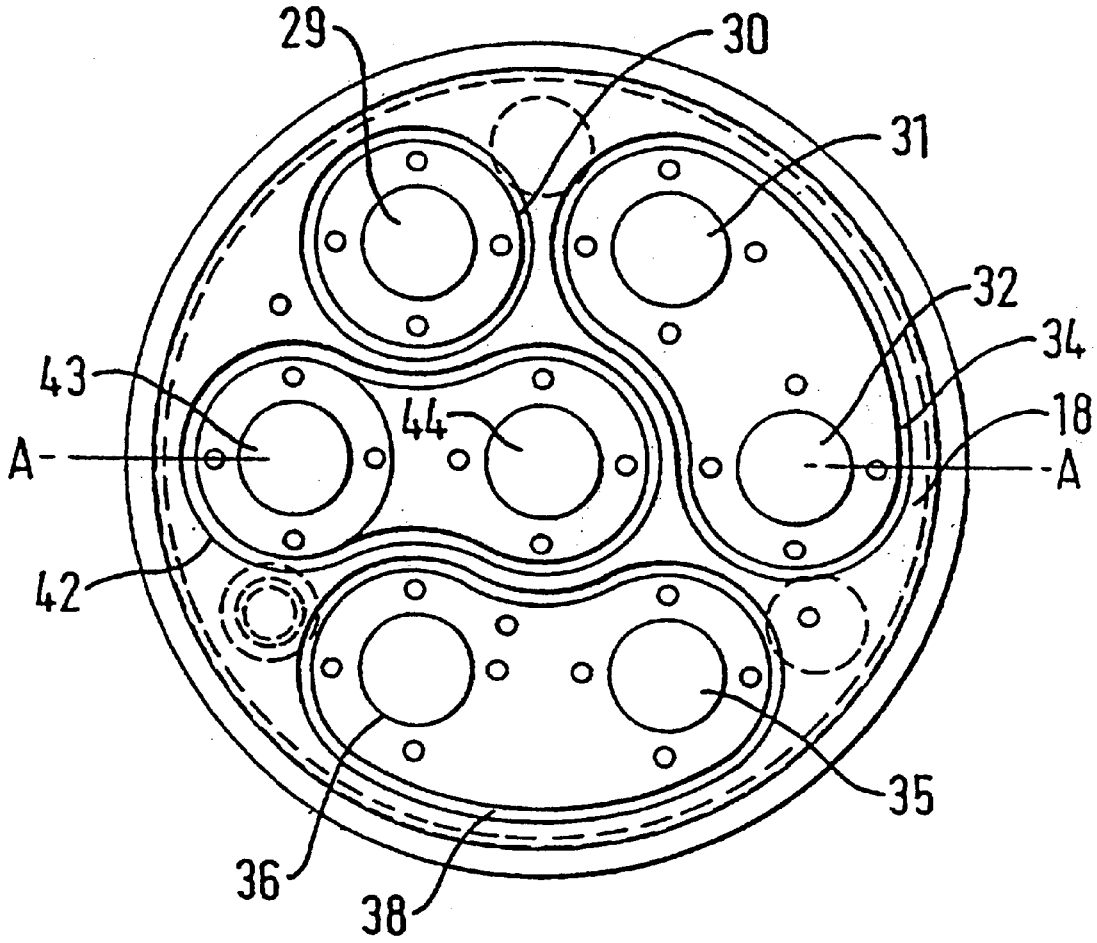
FIG. 20 is an end view of a multi-pass heat exchanger
Figure 21:
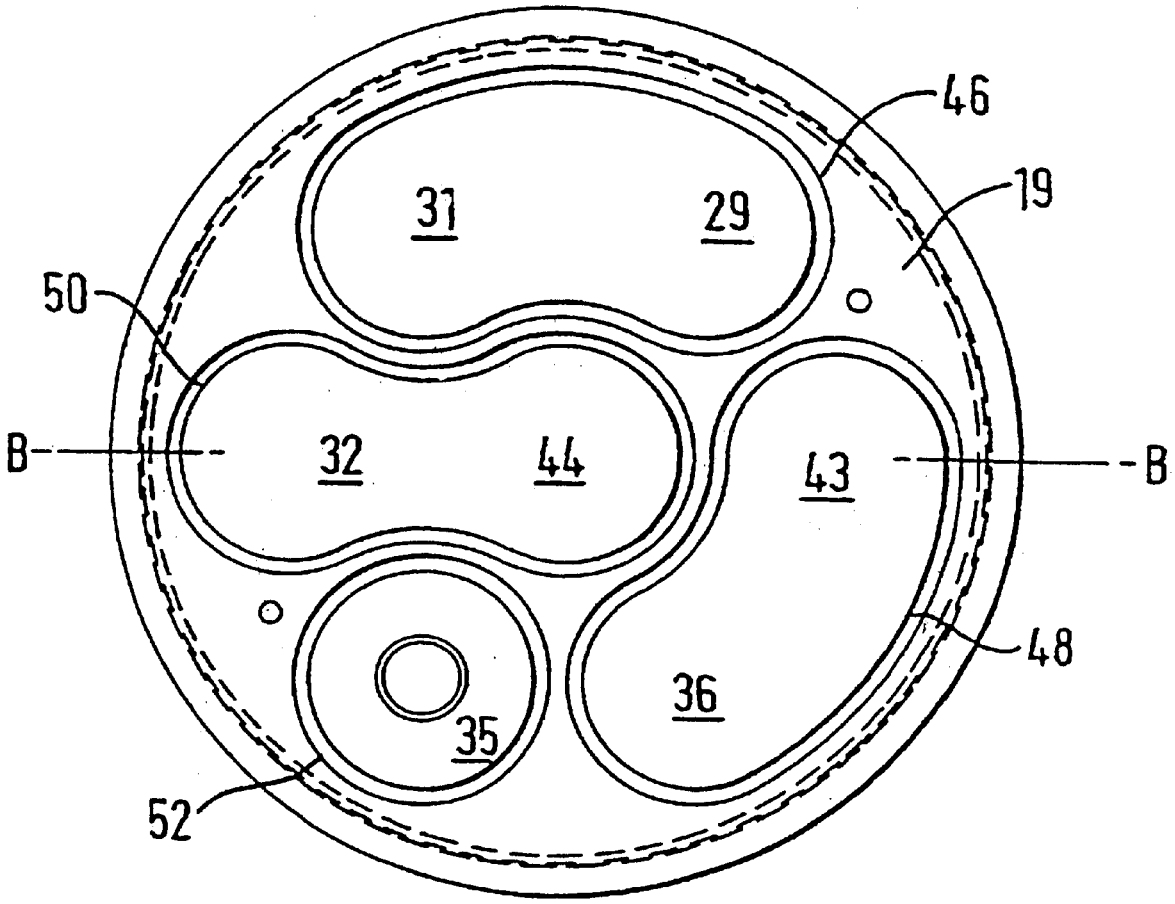
FIG. 21 is a view of the multi-pass heat exchanger of FIG. 20 as seen from the other end.
Figure 22:
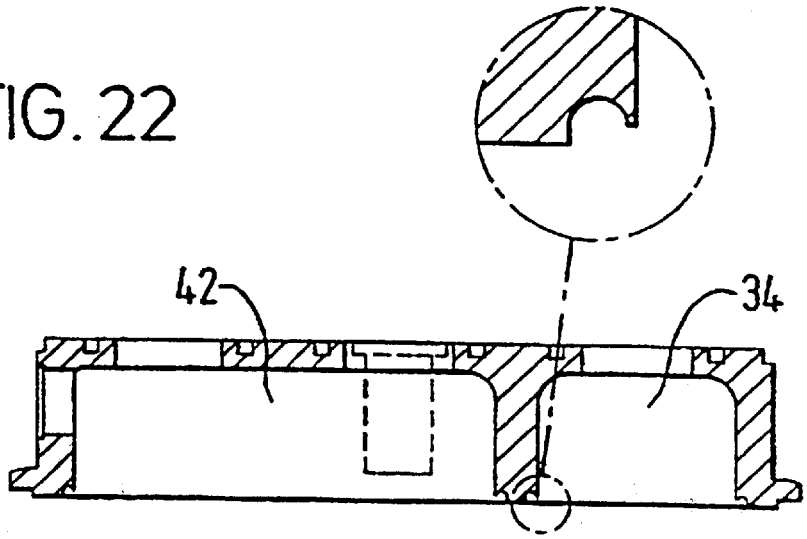
FIG. 22 is a section along line A—A of FIG. 21.
Figure 23:
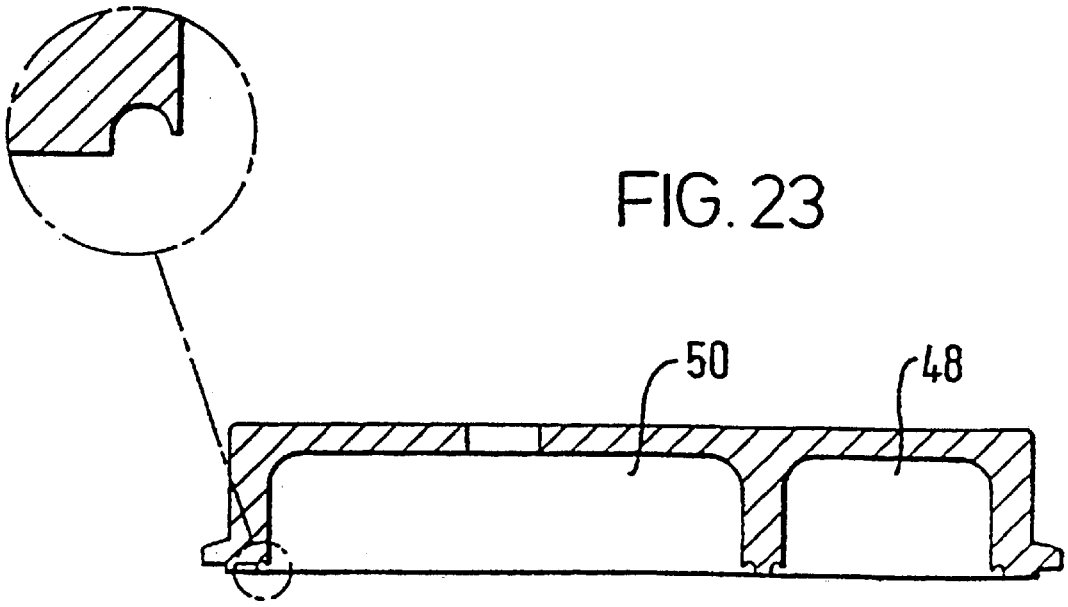
FIG. 23 is a section along line B—B of FIG. 20.

In a further embodiment of the invention, each rod 14 may carry a plurality of turbulence inducing elements or members 22 along its length (see FIGS. 18 and 19). Each of these members 22 is mounted substantially perpendicular to the axis of the rod 14 and so is generally perpendicular to the flow of fluid through the product pipe. The shape of the elements 22 is preferably substantially triangular, with the corners of the triangle being rounded off slightly. The size of the element 22 should be such that the corners of the triangle touch the inner wall of the conduits, but do not scrape it in use. The area of the surface that each member 22 presents to the fluid flow may be of the order of 30% of the cross sectional area of the product tube.

In use, the reciprocating motion of the rod 14 moves the elements 22 back and forth and induces an increased turbulence in the product. This turbulence enhances the efficiency of the heat exchange process and is particularly suitable for use when the product has a viscous consistency. As illustrated in FIGS. 18 and 19, although the elements 22 contact the inner wall of the conduit tube they do not scrape it. Although the elements are illustrated as having a triangular section, they may be of any cross sectional shape.

As illustrated in FIG. 19, each rod 14 carries a plurality of elements 22, each of which is positioned on the rod at a different orientation relative to adjacent such elements. In the illustrated embodiment the elements are angled apart at 180°, however, the elements 22 can be arranged relative to each other at any orientation.

What is claimed is:

1. A heat exchanger assembly which comprises a casing housing at least one product conduit extending substantially therethrough and with a void surrounding the product conduit receiving in use, heat exchange service fluid, wherein the assembly further comprises a mount extending through the product conduit, said mount being moveable in a reciprocating manner along the product conduit and having a scraping means projecting therefrom towards an inner wall of the product conduit wherein the scraping means comprises a scraping head movably mounted outwardly on an arm characterised in that the scraping head is resiliently biased towards a wall of the product by a resilient biasing means associated with or comprising the arm such that upon reciprocation of the mount within the product conduit, the scraping means will scrape residues from the inner wall of the product conduit.

2. A heat exchanger assembly as claimed in claim 1 having a plurality of product conduits extending substantially through the casing and a plurality of mounts, each mount extending through a respective said conduit, the mounts being moveable in a reciprocating manner together by a common reciprocating drive.

3. A heat exchanger assembly as claimed in claim 2 wherein the plurality of mounts is mounted in a base plate that is housed within the casing or an extension of the casing to move with the base plate, the base plate being moved in a reciprocating manner by the reciprocating drive.

4. A heat exchanger assembly as claimed in claim 1, wherein the scraping means comprises a plurality of scrapers arranged at intervals along the or each mount.

5. A heat exchanger assembly as claimed in claim 1 wherein the scraping means is formed of resilient material.

6. A heat exchanger assembly as claimed in claim 1, wherein the product conduit is a tube.

7. A heat exchanger assembly as claimed in claim 6, wherein the scraping means have an arcuate radially outer surface.

8. A heat exchanger assembly as claimed in claim 4, wherein the scrapers are arranged at different orientations along the length of the mount.

9. A heat exchanger assembly as claimed in claim 4 wherein the scraping means project radially from the mount.

10. A heat exchanger assembly as claimed in claim 9, wherein the scrapers are arranged in groups of two or three scrapers at intervals along the length of the mount with each member of the group at a different respective orientation around the axis of the mount.

11. A heat exchanger assembly as claimed in claim 1 wherein an outer surface of the scraping means matches the profile of the product conduit.

12. A heat exchanger assembly as claimed in claim 1, wherein the mount comprises a rod that extends through the product conduit.

13. A heat exchanger assembly as claimed in claim 1 wherein the product conduit extends substantially longitudinally through the casing housing.

14. A heat exchanger assembly as claimed in claim 2, wherein a product fluid inlet of the assembly is provided with a valve to prevent backflow of fluid, whereby the reciprocating drive pumps the product fluid.

15. A heat exchanger assembly as claimed in claim 1, wherein the assembly further comprises a controller to control the reciprocation of the mount at predetermined intervals or in response to sensed temperature of the product or service fluid.

16. A heat exchanger assembly as claimed in claim 4 wherein each of the plurality of scrapers extends around only a portion of the circumference of the mount.

17. A heat exchanger assembly as claimed in claim 16 wherein three distinct scrapers are disposed at each interval, the three distinct scrapers at each interval collectively extending around the entire circumference of the mount.

18. A heat exchanger assembly which comprises a casing housing at least one product conduit extending substantially therethrough and with a void surrounding the product conduit receiving, in use, heat exchanger service fluid, characterised in that the assembly further comprises a mount extending through the product conduit, said mount being moveable in and having a turbulence generating member projecting therefrom, such that upon reciprocation of the mount within the product conduit in use, the member causes turbulence within the product conduit without scraping an inner surface of the product conduit.

19. A heat exchanger as claimed in claim 18, wherein a plurality of turbulence generating members is provided.

20. A heat exchanger as claimed in claim 19, wherein each member is positioned at a different orientation around the axis of the mount.

21. A heat exchanger as claimed in claim 18, wherein the turbulence generating member has a triangular cross section, wherein each corner of the triangle substantially contacts an inner surface of the product conduit.

22. A heat exchanger as claimed in claim 21, wherein the corners of the triangle are rounded.

23. A heat exchanger assembly which comprises a casing housing at least one product conduit extending substantially therethrough and defining a heat exchanger surface in contact with a heat exchange service fluid space wherein the assembly further comprises a mount extending along the product conduit, said mount being moveable in a reciprocating manner along the product conduit and having a scraping means projecting therefrom towards a wall of the product conduit, characterised in that the scraping means comprises a scraping head moveably mounted on an arm such that it is resiliently biased towards a wall of the product conduit, such that upon reciprocation of the mount along the product conduit, the scraping means will scrape product residues from the wall of the product conduit.

* * * * *